United States Patent [19]

Kasiske, Jr. et al.

[11] Patent Number: 4,797,708

[45] Date of Patent: Jan. 10, 1989

[54] APPARATUS FOR SCAVENGING UNWANTED PARTICLES FROM A PHOTOCONDUCTOR OF AN ELECTROGRAPHIC APPARATUS

[75] Inventors: W. Charles Kasiske, Jr.; John M. Fiske, both of Rochester, N.Y.

[73] Assignee: Eastman Kodak Company, Rochester, N.Y.

[21] Appl. No.: 45,931

[22] Filed: May 4, 1987

[51] Int. Cl.[4] ..... G03G 21/00; G03G 15/00

[52] U.S. Cl. ..... 355/15; 355/3 R; 355/3 DD

[58] Field of Search ..... 355/3 DD, 3 R, 15

[56] References Cited

U.S. PATENT DOCUMENTS

| | | | |
|---|---|---|---|
| 2,998,802 | 9/1961 | Harris et al. | 355/15 |
| 3,543,720 | 12/1970 | Drexler . | |
| 3,974,952 | 8/1976 | Swanke et al. . | |
| 4,014,065 | 3/1977 | Hudson . | |
| 4,067,018 | 8/1975 | Pond | 355/15 X |
| 4,165,171 | 8/1979 | Lemmen | 355/15 |
| 4,210,397 | 7/1980 | Macaluso . | |
| 4,258,372 | 3/1981 | Ishikawa | 355/3 DD X |
| 4,469,427 | 9/1984 | Kopp et al. . | |
| 4,538,321 | 9/1985 | Binder et al. | 355/15 X |
| 4,551,001 | 11/1985 | Yokota | 355/3 R X |

OTHER PUBLICATIONS

Research Disclosure, Jan. 1985, Item 24942, pp. 73, 74.

*Primary Examiner*—A. T. Grimley
*Assistant Examiner*—Ed Pipala
*Attorney, Agent, or Firm*—Tallam I. Nguti

[57] ABSTRACT

In electrographic apparatus a latent image on a flexible photoconductor is developed with toner particles at a development station and subsequently transferred to a receiver sheet, such as a copy sheet, and then fused to the sheet. Sometimes unwanted particles also are on the photoconductor, including the area of a developed image on the photoconductor. Unless the unwanted particles are removed before the developed image is transferred to a copy sheet, the particles can create image voids or other defects in the image on the copy sheet. These particles are removed by a vacuum system including a plenum having an inlet opening located closely adjacent the surface of the photoconductor between the development station and the transfer station. It is important to precisely maintain the desired spacing between the vacuum plenum opening and the photoconductor. In order to maintain this spacing, the plenum is mounted for movement toward and away from a guide roller supporting the photoconductor, and tires on the ends of the plenum contact the roller so that the plenum moves with the roller and thus the photoconductor.

3 Claims, 3 Drawing Sheets

APPARATUS FOR SCAVENGING UNWANTED PARTICLES FROM A PHOTOCONDUCTOR OF AN ELECTROGRAPHIC APPARATUS

BACKGROUND OF THE INVENTION

The present invention relates to apparatus for removing unwanted particles from a photoconductor of an electrographic apparatus which has a developed image thereon so that the unwanted particles are not transferred to a copy sheet with the developed image.

Images are formed in an electrographic apparatus by moving a photoconductor in the form of a drum or flexible web past a series of stations in the apparatus. As this occurs, the photoconductor is charged, exposed to form a latent charged image on the photoconductor, and the image is then developed by moving it past a development station where charged toner particles of developer material are attracted to the charged latent image to develop the image. The developed image is transferred to a receiver sheet, such as a sheet of paper in a transfer station. The receiver sheet is advanced through a fusing station where the toner particles are heated and fused to the sheet. Particles remaining on the photoconductor are removed at a cleaning station prior to again charging the photoconductor and repeating the process.

During operation of an electrographic apparatus some unwanted particles may be deposited onto the photoconductor before it reaches the transfer station, and these particles should be removed in order to avoid imperfections in the image on the copy sheet. The unwanted particles may comprise, for example, toner aggregates or agglomerations (sometimes referred to as toner flakes), particles of carrier from the developer material, paper dust, or fibers of brushes used for cleaning the photoconductor. Particularly objectionable are any such unwanted particles that are present within the image area on the photoconductor prior to the time the image reaches the transfer station where it is to be transferred to a copy sheet or other receiver sheet.

The unwanted particles may be large in comparison to the small individual toner particles which form the developed image, and are sometimes referred to as "tent poles". When the receiver sheet and the photoconductor are brought into contact or close proximity for transfer of the image, the receiver sheet in the area around a large unwanted particle or tent pole is held away from the photoconductor by the particle. As a result, some of the small toner particles in the image area around the large particle on the photoconductor do not transfer to the receiver sheet. The effect on the final copy or transfer sheet is an area of low density toner image, sometimes surrounding a black spot when the unwanted particle also transfers to the receiver sheet. These defects in image quality should be avoided, especially in half tone and solid density areas of an image where image quality voids are most noticeable.

The developer material used for developing the latent images on the photoconductor sometimes comprises a two-component developer including ferromagnetic carrier particles and toner particles. The carrier particles should not be transferred to the photoconductor, but some do and they too will degrade the image if not removed before transfer to a copy sheet. These ferromagnetic carrier particles can be removed by a magnetic scavenger located downstream of the development area, as disclosed in commonly-assigned U.S. Pat. No. 3,543,720, which issued on Dec. 1, 1970 in the names of R. A. Drexler et al.

It also is known to use positive air pressure for removal of agglomerations or "tent poles" of material from a developed image on a photoconductor. A positive air pressure system and apparatus is disclosed in item 24942 found on pages 73 and 74 of the January, 1985 edition of *Research Disclosure,* published by Kenneth Mason Publications Limited, the old Harbourmaster's, 8 North Street, Emsworth, Hampshire P.O. 10 7DD, England.

Vacuum or negative air pressure also has been used to remove unwanted particles from a photoconductor. See for example, U.S. Pat. No. 4,014,065, issued Mar. 29, 1977 in the name of F. W. Hudson, which discloses a vacuum system for removing unwanted particles from the background area of a photoconductor. In accordance with the Hudson patent a uniform air flow across the photoconductor is provided by a chamber entrance port mush smaller than the exit port. Also, the vacuum apparatus is disclosed in connection with a photoconductor on the surface of a rigid drum where it is much easier to maintain a desired relationship between the entrance port and the photoconductor than with a flexible photoconductor.

When the photoconductor is in the form of a web, the photoconductor flexes and it is difficult to constantly maintain the desired relationship between the vacuum system and the photoconductor with the kind of accuracy required for removing unwanted particles from an image area of the photoconductor without also removing toner particles from the image area. More specifically, due to movement of the photoconductor relative to the vacuum system, the vacuum applied to the image area may not be great enough to remove the unwanted particles or may be so great as to remove not only the unwanted particles, but also the toner particles forming the image that is to be transferred to a copy sheet. Also, the vacuum system can contact the toner image on the photoconductor and damages the image, or contact and scratch the photoconductor unless the desired relationship between the vacuum system and photoconductor is maintained. Another problem that can occur if the proper relationship is not maintained between the photoconductor and a vacuum scavenger is that the vacuum system can tend to draw the photoconductor into the entrance slot of the vacuum system at the operating level of the vacuum system.

The difficulty in consistently maintaining a specific relationship between the vacuum system and a flexible photoconductor is even more difficult when a movable roller is urged against the photoconductor between the development station and the transfer station in order to tension the photoconductor. More specifically, the tension roller moves toward and away from the photoconductor in response to forces exerted on the photoconductor during operation of the electrographic apparatus, and this produces localized flexing of the photoconductor in the exact area where the vacuum system must be accurately spaced from the photoconductor in order to most effectively remove the unwanted particles without damaging a developed image or the photoconductor.

SUMMARY OF THE INVENTION

Accordingly, it is an object of the invention to provide a vacuum system for removal of unwanted particles from a photoconductor after development of a latent image on the photoconductor and before transfer of that image to a receiver sheet. Another object of the invention is to provide a vacuum system for removal of unwanted particles from an unfused image area on a flexible photoconductor wherein a specific spacing between the vacuum system and photoconductor is maintained even though the photoconductor is flexible and subject to movement in the area adjacent the vacuum system. Another object is to provide a vacuum system as described which consistently removes unwanted particles from an unfused image on a photoconductor without scratching the photoconductor or significantly disturbing the image.

The invention relates to an improvement in electrographic apparatus having a flexible photoconductor on which a latent image is formed. The apparatus has a development station at which the latent image is developed with toner particles, a transfer station at which a developed image is transferred to a receiver sheet, and a roller for guiding movement of the photoconductor from the development station toward the transfer station. The improvement of the invention comprises a vacuum plenum having an elongate entrance slot through which air can be drawn into the plenum and an exit opening adapted to be connected to a source of negative pressure. Means are provided for mounting the plenum relative to the roller so that the plenum slot is closely adjacent the photoconductor as it is guided along the roller. The mounting means comprises means for urging the plenum slot toward the roller, and means supported by the plenum and engageable with end portions of the roller for holding the slot a predetermined distance from the roller. The mounting means maintains the plenum slot a predetermined distance from the photoconductor as the photoconductor is guided over the roller.

BRIEF DESCRIPTION OF THE DRAWINGS

In the detailed description of the preferred embodiment of the invention presented below, reference is made to the accompanying drawings, in which.

DESCRIPTION OF A PREFERRED EMBODIMENT

Figure 1:
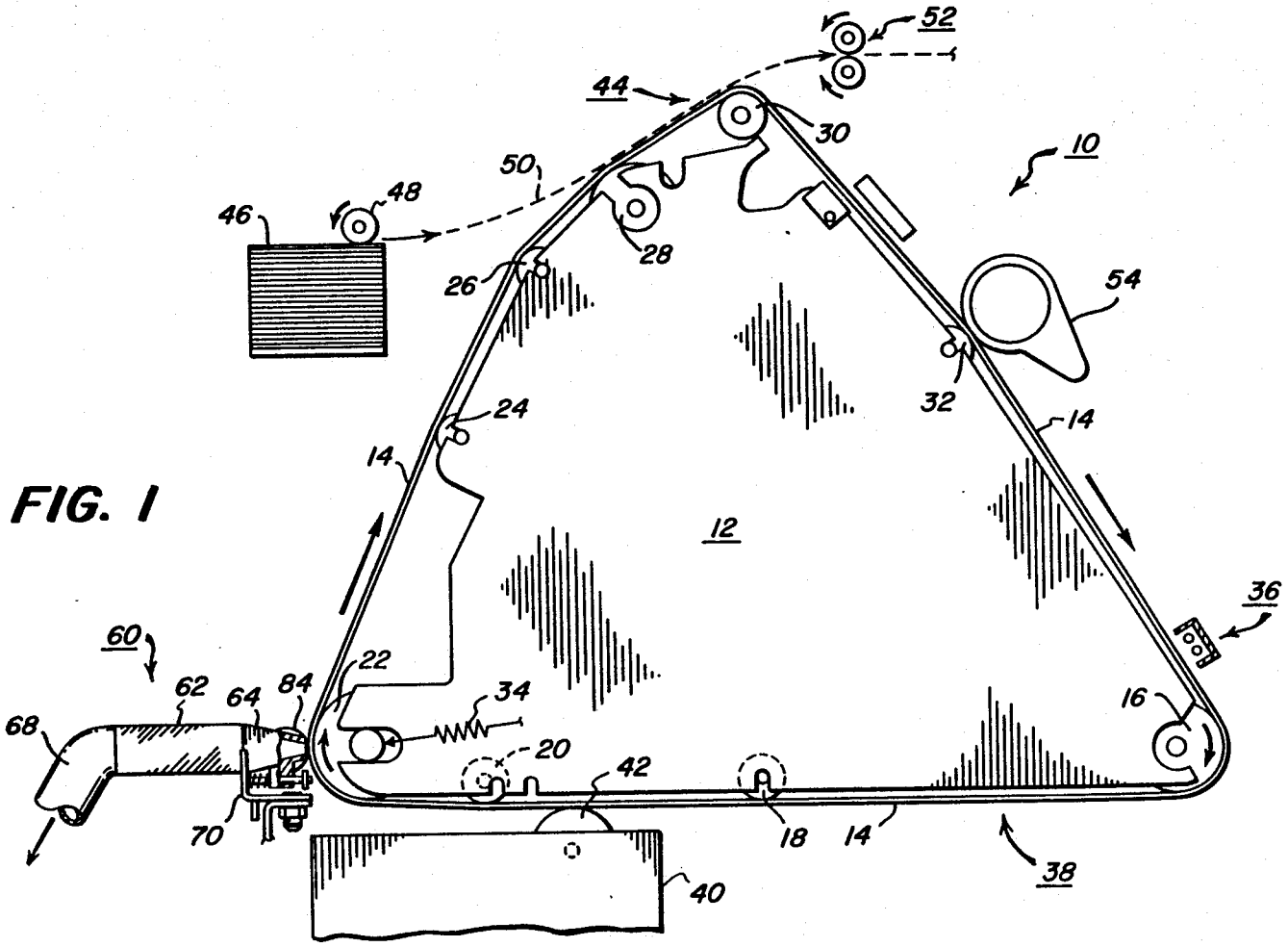
FIG. 1 is a schematic elevation view of a portion of an electrographic apparatus incorporating scavenging apparatus of the present invention.

Referring initially to FIG. 1, electrographic apparatus generally designated 10 includes a plate 12 that forms part of a framework for supporting an endless flexible photoconductor 14 for movement in a clockwise direction as indicated by the arrows. The photoconductor is supported by a drive roller 16 and a plurality of idler rollers 18, 20, 22, 24, 26, 28, 30 and 32. A spring diagrammatically shown at 34 urges roller 22 against the photoconductor to maintain the photoconductor under slight tension. This mounting of the photoconductor results in some movement of the tension roller 22 and the photoconductor in the area adjacent the roller.

The photoconductor is driven past a charging station 36 where a uniform electrostatic charge is applied to the outer surface of the photoconductor. Then the photoconductor moves through an imaging station 38 where the photoconductor is exposed to light rays, for example, to selectively discharge part of the electrostatic charge and form an electrostatic latent image on the photoconductor. The photoconductor next moves past a development station 40 illustrated as having a magnetic brush 42 for providing marking particles, such as toner particles, to the electrostatic image on the photoconductor. The toner particles have a charge that is opposite to the charge of the electrostatic latent image on the photoconductor so that toner particles transfer from the magnetic brush 42 to the latent image to develop it with small toner particles.

The developed image is transported to a transfer station in the area designated 44 where the developed image is transferred from the photoconductor to a copy sheet fed from a stack of sheets 46 by a paper feed mechanism 48. The copy sheet travels along a path 50 to the transfer station, and after the image has been transferred to it, is separated from the photoconductor and delivered through a fusing station 52 where the toned image is fused to the copy sheet. The copy sheet is then delivered to a tray where it is accessible by the machine operator.

After leaving the transfer station the photoconductor passes a cleaning station 54 where it is cleaned of any residual toner particles or other materials on the photoconductor prior to being subjected to a charge at station 36. Electrographic apparatus 10 as generally described hereinbefore is known in the art and is disclosed, for example, in commonly assigned U.S. Pat. No. 3,974,952 entitled "Web Tracking Apparatus" which issued on Aug. 17, 1976 in the names of T. Swanke et al.

As explained hereinbefore, unwanted particles in a developed image on the photoconductor 14 need to be removed prior to transfer of the developed image to a copy sheet 46. Scavenging apparatus generally designed 60 is provided for removing such unwanted particles from developed images on the photoconductor prior to the time the images reach the transfer station 44.

Figure 2:
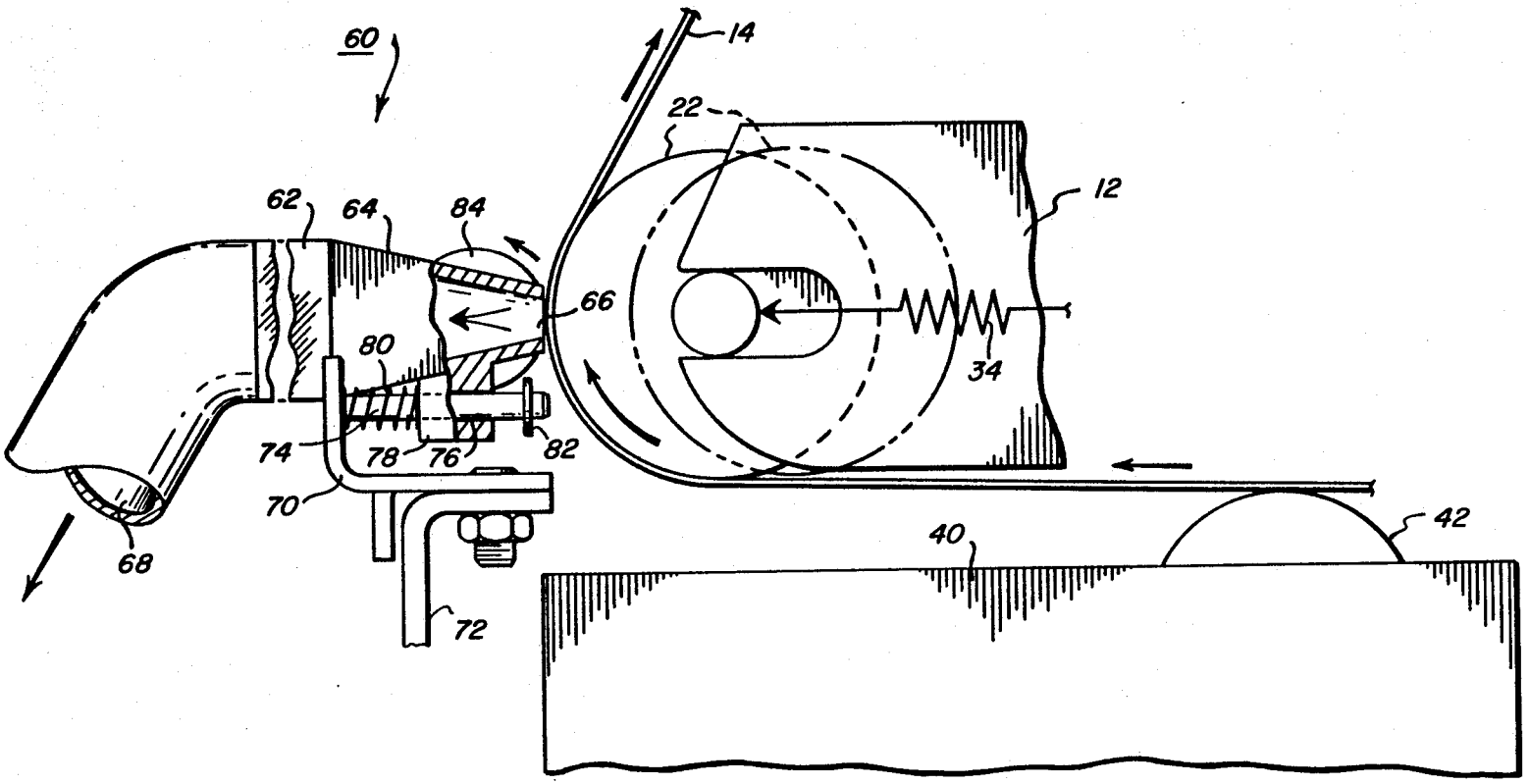
FIG. 2 is an enlarged fragmentary view of a portion of the apparatus shown in FIG. 1.
Figure 3:
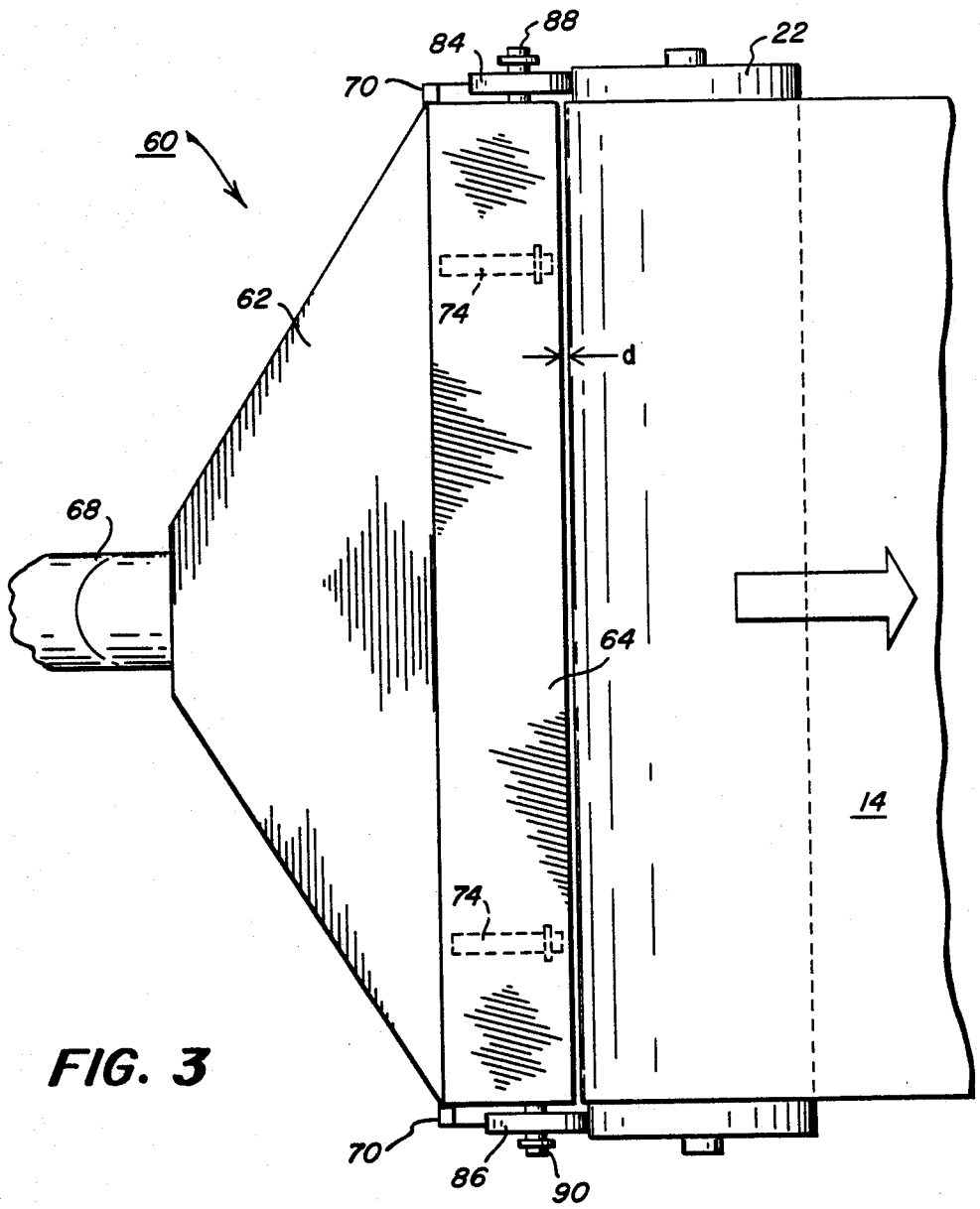
FIG. 3 is a plan view of the lower left portion of the apparatus illustrated in FIG. 1.

As best shown in FIGS. 2 and 3, scavenging apparatus 60 comprises a vacuum plenum 62 having an elongate, thin, end portion 64 with an entrance slot 66 through which air can be drawn into the plenum. Plenum 62 also has a cylindrical exit opening 68 which is connected by a hose (not shown) or other suitable means to a source of negative pressure, such as the vacuum system for cleaning station 54 or a separate blower system. The width of end portion 64 of the plenum is substantially equal to the width of the photoconductor and slightly narrower than roller 22. The plenum is generally thin and tapers from the ends of the entrance slot 66 to the exit opening 68.

As illustrated in FIG. 2, the plenum is supported by a bracket 70 which is mounted on a frame bracket 72 that is fixed in the apparatus 10. One or more spaced pins 74 project from the bracket 70 through slots 76 in a flange 78 depending from the plenum. A spring 80 is coiled around each pin 74 and compressed between bracket 70 and the flange 78 of the plenum so that the springs 80 exert a force urging the plenum to the right and toward roller 22. Washers 82 on the outermost ends of the pins 74 limit movement of the plenum relative to the pins when the roller is retracted to its dotted line position as explained later.

A pair of tires 84, 86 are journaled on pivots 88, 90 projecting from opposite ends of the plenum 62. Tires 84, 86 are mounted on the plenum so that they project slightly beyond the entrance slot 66 in the plenum. The length of the plenum and position of the tires is such that the tires engage opposite end portions of roller 22 on which the photoconductor 14 is guided from the development station 40 toward the transfer station 44. Thus while springs 80 urge the plenum toward roller 22, tires 84, 86 hold the edge of the plenum containing slot 66 a predetermined distance d (FIG. 3) from the photoconductor as it is guided around the roller. As roller 22 moves in a left to right direction, as viewed in FIG. 2, in response to the force of spring 34 and the tension in photoconductor 14, the plenum 62 closely follows movement of the roller and precisely maintains the spacing d between the slot 66 and the photoconductor and roller due to the unique mounting of the plenum relative to the roller.

During operation of the apparatus 10 a latent electrostatic image formed on the photoconductor in station 38 is developed in station 40 and travels around roller 22 on the way to the transfer station 44. The developed image is formed of small toner particles that have a charge opposite to the electrostatic charge of the latent image on the photoconductor and thus the toner particles tend to cling to the photoconductor. As explained earlier, some unwanted particles may be on the photoconductor, not only in the background area but also in the developed image, and it is important that these unwanted particles be removed prior to the time the developed image reaches the transfer station 44.

As the developed image travels around roller 22, vacuum or a negative pressure is applied to the exit opening 68 or plenum 62 to thereby create a suction at the entrance slot 66. Slot 66 is precisely located with respect to the photoconductor and roller 22 due to spring 34 urging roller 22 to the left and springs 80 urging the plenum 62 to the right to bring the tires 84 into contact with the ends of the roller 22. During operation roller 22 may move slightly to the left and right as viewed in FIGS. 1 and 2 in response to pressures applied to the photoconductor 14 at the various stations around the photoconductor and the pressure exerted by spring 34. However, the precise spacing between the entrance slot 66 and the photoconductor 14 remains essentially constant at all times during operation due to forces exerted by springs 34 and 80, together with the tires 84 and the construction of the apparatus as described before.

The air flow into the entrance slot past the developed image on the photoconductor creates a suction closely adjacent the surface of the photoconductor which effects removal of most, if not all, of the unwanted particles on the photoconductor, including specifically those unwanted particles in the developed image on the photoconductor. However, very few of the toner particles forming the image are removed by the apparatus of the invention. In this regard, it will be remembered that the charged toner particles are held onto the photoconductor by the attraction of the oppositely charged electrostatic image on the photoconductor. Unwanted particles such as brush fibers etc. may not have an electrostatic charge or may have the same charge as the electrostatic latent image. Therefore, the unwanted particles are more likely to be removed by the vacuum system than the toner particles. In addition, some of the large unwanted particles form "tent poles" and thus project from the photoconductor by a distance greater than the toner particles in the developed image area. These tent poles, being nearer to the entrance slot 66, are more likely to be removed than those particles spaced a greater distance from the entrance slot. Also, many of the unwanted particles are large compared to the toner particles and thus more likely to be removed by the vacuum system.

By way of example, the entrance slot 66 of the plenum may be approximately 0.20 inch high and extend approximately 15 inches along the photoconductor (substantially the same length as the photoconductor). The apparatus holds the entrance slot spaced from the photoconductor to a nominal film-to-entrance slot spacing d of 0.010 inches. The force exerted by springs 80 onto the tension roller 22 can be approximately 9 or 10 ounces, plus or minus 2 to 3 ounces depending on the location of roller 22. The air flow through the plenum applied by the vacuum system connected to the outlet port 68 may be about 4.4 cubic feet/minute, thus producing a velocity of about 2100 feet/minute near the surface of the photoconductor adjacent the entrance slot 66.

Care should be taken to avoid positioning the entrance slot 66 too close to the photoconductor 14. If the entrance slot is too close to the photoconductor, then it can physically contact and dislodge some of the small, individual toner particles needed for forming the developed image on the photoconductor, or may even result in scratching of the photoconductor in the event there is physical contact between the plenum and the photoconductor. While tires 84, 86 are shown contacting roller 22 at the ends of the photoconductor, the tires could ride along the side edges of the photoconductor outside the image area on the photoconductor.

At times the photoconductor 14 must be removed from apparatus 10 either for replacement of the photoconductor or for other service of apparatus 10. When that occurs roller 22 is retracted approximately to its dotted line position shown in FIG. 2 and latched in that position by a suitable mechanism as indicated in the before-mentioned U.S. Pat. No. 3,974,952. When this occurs it is preferred that the tires of apparatus 60 be held out of contact with roller 22 so that the scavenging apparatus does not interfere with replacement of the photoconductor 14 or other service. This separation occurs automatically with apparatus 60 because flange 78 contacts washers 82 and thus limits movement of the plenum to the right. Flange 78 and washers 82 are located with respect to each other so that the entrance slot 66 is spaced from roller 22 and photoconductor 14 when roller 22 is retracted to its dotted line position for removal of the photoconductor.

The specific dimensions, air flow rates and velocities, etc. given hereinbefore by way of example can be varied, as desired, for a specific application of the invention. In constructing the scavenging apparatus for a particular electrographic apparatus, the air velocity at the entrance slot 66 should be sufficient to remove large unwanted particles, such as tent poles, but should not be sufficiently large to dislodge or remove any significant quantity of the relatively small particles of toner forming the developed image. By way of example, the entrance slot 66 might be spaced from roller 22 by a distance of about 0.005 inch to about 0.035 inch. Such spacing, together with an air flow through the plenum of about 4 to 10 cubic feet/minute will produce an air velocity near the film surface of about 1300 to about 2300 feet/minute. These values also may be changed as required for a particular system.

A number of advantages are achieved by the present invention. First of all, a substantially consistent or constant velocity of air flow is obtained closely adjacent the surface of the photoconductor so that the system is effective to remove the relatively large unwanted particles without significantly disturbing the individual toner particles that form the developed image. The air flow is constant throughout the width of the photoconductor, and for each increment of the photoconductor that passes the slot 66, so that all parts of successive images on the photoconductor are purged of unwanted particles.

The apparatus of the invention removes unwanted particles from the image area as well as the background area on the photoconductor. By removing such unwanted particles from the image area, the image ultimately transferred to a copy or receiver sheet 46 in station 44 is more substantially free of objectionable image voids formed by tent poles and other particles as explained hereinbefore.

Another advantage of the invention is its ability to work effectively with a web photoconductor that is trained about a plurality of rollers and flexes in the area between the rollers. Attempts to hold a close tolerance between a vacuum plenum and such a web is very difficult due to flexing of the web in response to the forces applied to the web during operation of apparatus 10. Moreover, this problem is compounded when there is a tension roller as shown at 22 between the development station 40 and the transfer station 44, and it is urged by a spring against the photoconductor to maintain tension in the photoconductor. With this arrangement there is more fluctuation in the portion of the photoconductor between the development and transfer stations where the scavenging apparatus preferably is located. However, the scavenging apparatus of the invention is urged into engagement with tension roller 22 and constantly maintains the desired spacing between the plenum and the photoconductor. This produces a consistency in air flow across the photoconductor even when the roller 22 moves to maintain the desired tension in the photoconductor. Also, by locating the scavenging apparatus relative to the tension roller 22, as described, the photoconductor is not into the entrance slot 66.

The invention has been described in detail with particular reference to a preferred embodiment thereof, but it will be understood that variations and modifications can be effected within the spirit and scope of the invention.

We claim:

1. In electrographic apparatus having a plurality of rollers guiding an endless flexible photoconductor along a path past a series of stations including an imaging station at which a latent image is formed on the photoconductor, a development station at which the latent image is developed with toner particles, and a transfer station at which the developed image is transferred to a receiver sheet, one of the rollers guiding the photoconductor being located between the development station and the transfer station, spring means for urging the one roller toward the photoconductor to tension the photoconductor, the improvement comprising:

a vacuum plenum having (a) an elongate entrance slot through which air can be drawn into the plenum and (b) an exit opening adapted to be connected to a source of negative pressure;

means for mounting the plenum adjacent the one roller, the mounting means comprising at least one pin slidably supporting the plenum, and spring means for urging the plenum toward the one roller, the plenum being positioned on the mounting means with the slot facing and adjacent the one roller; and a plurality of tires carried by the plenum and engageable with end portions of the one roller for limiting movement of the plenum slot toward the one roller by the spring means, wherein the one roller of the electrographic apparatus is movable away from the photoconductor into a retracted position for removing tension on the photoconductor, and the improvement further comprises stop means for limiting movement of the plenum toward the one roller by the spring means when the one roller is in its retracted position, thereby providing sufficient space between the one roller and the plenum for replacement of the photoconductor.

2. In electrographic apparatus having a flexible photoconductor on which a latent image is formed, the apparatus having a development station at which the latent image is developed with relatively small toner particles, a transfer station at which a developed image is transferred to a receiver sheet, a station at which the toner image is fused to the receiver sheet, and wherein the image developed on the photoconductor may contain unwanted particles larger than the toner particles which can produce image quality defects in the fused image unless such unwanted particles are removed from the developed image before it is fused to the receiver sheet; the improvement comprising:

scavenging apparatus for removing unwanted particles from developed images on the photoconductor, the scavenging apparatus comprising a vacuum plenum having an entrance slot through which air can be driven into the plenum, means for precisely locating and maintaining the slot of the plenum a predetermined distance from the photoconductor in an area between the development station and the transfer station, the distance between the plenum slot and the photoconductor being greater than the thickness of a developed image on the photoconductor so that the plenum does not contact the developed image, and means for establishing an air flow into the entrance slot past a developed image to produce a suction at the surface of the developed image which is effective to selectively remove unwanted particles from the developed image without removing a significant quantity of toner particles forming the developed image wherein the distance between the slot and the photoconductor is greater than about 0.005 inch, and the means for establishing an air flow produces an air velocity near the developed image on the photoconductor of greater than about 1300 feet per minute.

3. In electrographic apparatus having a flexible photoconductor on which a latent image is formed, the apparatus having a development station at which the latent image is developed with a quantity of relatively small individual toner particles having a charge opposite to the electrostatic charge of the latent image, a transfer station at which a developed image is transferred to a receiver sheet, a station at which the toner image is fused to the receiver sheet, and wherein the image developed on the photoconductor may contain unwanted particles larger than the individual toner particles which can be transferred to the receiver sheet and produce image quality defects in the fused image unless such unwanted particles are removed from the developed image before it is transferred and fused to the receiver sheet; the improvement comprising:

scavenging apparatus for removing unwanted particles from developed images on the photoconductor, the scavenging apparatus comprising a vacuum plenum having a narrow entrance slot through which air can be driven into the plenum, the width of the slot being approximately equal to the width of the photoconductor, means for precisely locating and maintaining the slot of the plenum a predetermined distance from the photoconductor in an area between the development station and the transfer station, the distance between the plenum slot and the photoconductor being greater than the thickness of a developed image on the photoconductor so that the plenum does not contact the developed image, and means for establishing an air flow into the entrance slot past a developed image to produce a suction at the surface of the developed image, the air flow rate past the developed image and the distance between the plenum slot and the developed image being such that relatively large unwanted particles are selectively removed from the developed image without removing a significant quantity of small toner particles forming the developed image wherein the distance between the slot and the photoconductor is about 0.005 to about 0.035 inch, and the means for establishing an air flow produces an air velocity near the developed image on the photoconductor of about 1300 to about 2300 feet per minute.

* * * * *